United States Patent [19]

Allen

[11] Patent Number: 4,592,405

[45] Date of Patent: Jun. 3, 1986

[54] SQUEEZE CASTING OF ARTICLES

[75] Inventor: Gordon L. Allen, Rugby, England

[73] Assignee: AE PLC, Warwickshire, England

[21] Appl. No.: 592,860

[22] Filed: Mar. 23, 1984

[30] Foreign Application Priority Data

Mar. 24, 1983 [GB] United Kingdom ..... 8308174

[51] Int. Cl.[4] ..... B22D 18/02

[52] U.S. Cl. ..... 164/120; 164/320; 164/341

[58] Field of Search ..... 164/120, 137, 320, 341, 164/342, 347

[56] References Cited

U.S. PATENT DOCUMENTS

| | | | |
|---|---|---|---|
| 3,068,539 | 12/1962 | Wilcoxon | 164/320 |
| 3,120,038 | 2/1964 | Lauth | 164/320 |
| 3,199,159 | 8/1965 | Wernecke | 164/341 |
| 3,262,164 | 7/1966 | Meves | 164/341 |
| 3,654,986 | 4/1972 | Jansen | 164/137 |
| 3,763,925 | 10/1973 | Sieger | 164/341 |
| 4,206,799 | 6/1980 | McDonald | 164/341 |
| 4,492,264 | 1/1985 | Gaddi | 164/341 |

FOREIGN PATENT DOCUMENTS

| | | |
|---|---|---|
| 7226963 | 7/1972 | France . |
| 8100139 | 1/1981 | France . |
| 57-15689 | 12/1982 | Japan . |
| 1034425 | 12/1962 | United Kingdom . |
| 2044647 | 3/1980 | United Kingdom . |
| 2067441 | 1/1981 | United Kingdom . |

*Primary Examiner*—W. D. Bray

*Attorney, Agent, or Firm*—Leydig, Voit & Mayer, Ltd.

[57] ABSTRACT

A squeeze casting press has a movable top die part (11) and movable side die parts (13). When these parts are in a die-forming position, the side die parts (13) are locked against movement by respective locking wedges (25) to prevent these die parts separating under the squeeze casting pressure. The provision of movable die side parts allows easy access to the cast article (which may be a piston for an engine or a compressor). It also allows easy location in the die of reinforcements or inserts to be cast into the article.

10 Claims, 3 Drawing Figures

SQUEEZE CASTING OF ARTICLES

BACKGROUND TO THE INVENTION

1. Field of the Invention

The invention relates to the squeeze casting of metal articles and particularly, although not exclusively, to the squeeze casting of metal pistons for engines or compressors.

Squeeze casting is a process in which a molten metal is placed in a die and is then solidified under a force of many tons in order to produce an article which is of greater strength than conventional gravity cast articles by the elimination of voids and the production of a particularly homogeneous structure. The squeeze casting of pistons of engines or compressors is particularly desirable because of the improved properties which it gives to such pistons.

2. Review of the Prior Art

In general, a squeeze casting die has sides, a bottom and a top die part, with the top die part being movable from a retracted position, to allow molten metal to be poured into the die, to a position in which the top die part closes the die and applies the squeeze force to the solidifying metal. Such dies have a problem, however, in that the interior of the die is not readily accessible both for removal of the article after squeeze casting and, where required for the insertion into the die of inserts or other reinforcements around which the article is to be squeeze cast.

In order to overcome this problem, it would be necessary to form the sides of the die in two or more parts at least one of which is movable away from the die-forming position in order to give access to the interior of the die. There is a problem, however, with such an arrangement because the squeeze casting pressure of many tons applied by the top die part during casting tends to separate such side die parts and so split the die.

One attempt to overcome this problem is shown in U.S. Pat. No. 3,120,038 where the sides of the die are formed by two side die parts carried on respective arms which are pivotable about respective parallel horizontal axes. The arms are pivoted downwardly into alignment to inter-engage the two die side parts. The molten metal is allowed to solidify partially before the pressure is applied and the arms and the pivots can thus take the load imposed on the die side parts by the applied pressure to prevent the side die parts splitting.

It is a disadvantage of this arrangement that partial solidification is necessary before pressure is applied so that the full benefits of squeeze casting are not obtained. In addition only limited separation of the side die parts is available because only limited pivotal movement (about 20°) of the arms is provided. This makes access to the interior of the die difficult, for removal of the squeeze cast article, for the insertion of any insert or reinforcement into the die, for cleaning of the die and for applying a parting medium to the interior surfaces of the die. In addition, this limited opening will not, in some cases, allow the die parts to be formed with projections or recesses because of the difficulty of disengaging such projections or recesses from the cast article as a result of the limited opening of the die parts.

SUMMARY OF THE INVENTION

According to a first aspect of the invention, there is provided a method of forming an article by squeeze casting using a casting die including a top die part and at least one side die part movable into and out of engagement with other die parts to form the die, the method comprising moving the top die part and the at least one side die part to a die-forming position, moving a side die locking member into engagement with the movable side die part to lock the side die part into the die-forming position, squeeze casting the article, retracting the top die part, disengaging the locking member and retracting the at least one movable side die part, to allow removal of the case article, and then reforming the die for a subsequent squeeze casting step.

According to a second aspect of the invention, there is provided a squeeze casting press comprising a casting die including a top die part and at least one side die part movable into and out of engagement with other die parts to form the die, the press also including at least one side locking member so movable into engagement with an associated die side part, when the die is formed, as to prevent movement of the side die part when the top die part applies squeeze casting pressure, and being movable out of engagement with the associated side die part after squeeze casting has been performed to allow the side die part to be retracted from the die-forming position to permit the squeeze cast article to be removed.

According to a third aspect of the invention, there is provided a squeeze casting press for casting pistons for engines or compressors and comprising a casting die including a top die part and two side die parts movable into and out of engagement with other die parts to form a die, the side die parts having respective projections for forming on the casting respective gudgeon pin bore parts and being movable out of engagement with one another in opposite directions parallel to the axis of the gudgeon pin bore to disengage the projections from the casting.

According to a fourth aspect of the invention, there is provided a squeeze cast article, particularly a piston for an engine or a compressor when made by the method of the first aspect of the invention or when made using the press of the second or third aspects of the invention.

BRIEF DESCRIPTION OF THE DRAWINGS

The following is a more detailed description of an embodiment of the invention, by way of example, reference being made to the accompanying drawings in which.

DESCRIPTION OF THE PREFERRED EMBODIMENTS

Figure 1:
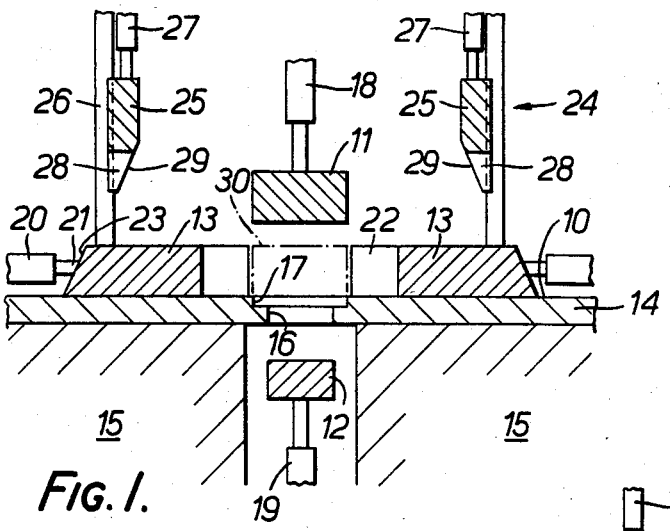
FIG. 1 is a schematic vertical cross-section of a squeeze casting press, with the press parts in retracted positions.

The squeeze casting press now to be described with reference to the drawings is a press for squeeze casting pistons for engines or compressors from an aluminium or aluminium alloy. It will be appreciated, however, that similar techniques may be used for squeeze casting other articles from other materials.

Referring now the drawings, the squeeze casting press comprises a fixed die part 10 and four movable die parts; a top die part 11, a bottom die part 12 and two side die parts 13. The fixed die part 10 is formed as an annular aperture in a flat base 14 which rests on a solid foundation 15. The annular aperture has a lower portion 16 of lesser diameter and an upper portion 17 of greater diameter.

The top die part 11 is mounted on a piston of a top hydraulic ram 18 for up and down movement in a vertical direction. The top die part 11 is, in this example, of circular cross-section with diameter substantially equal to the diameter of, and an axis aligned with the axis of, the greater diameter portion 17 of the fixed die part 10.

The bottom die part 12 is carried on a piston of a bottom hydraulic ram 19 for up and down movement in a vertical direction which is aligned with the axis of the fixed die part 10 and with the axis of the top die part 11. The bottom die part 12 is circular in cross-section and has a diameter substantially equal to the diameter of the lesser diameter part of the fixed die part 10.

Each side die part 13 is slidable in guides (not shown) carried on the base 14 for rectilinear movement in a horizontal direction under the action of a side hydraulic ram 20 connected to the associated side die part 13 by a piston 21. Each side die part 13 is provided with a semi-cylindrical die cavity 22 whose diameter is equal to the diameter of the greater diameter portion 17 of the fixed die part 10. At an end opposite the die cavity 22, each side die part is formed with an inclined end surface 23, whose purpose will be described in more detail below.

A locking member 24 is provided for each side die part 13. Each locking member 24 comprises a locking wedge 25 mounted for vertical sliding movement on a guide 26 which if fixed on the base 14. The movement of each locking wedge 25 is by means of an associated hydraulic ram 27.

Figure 3:
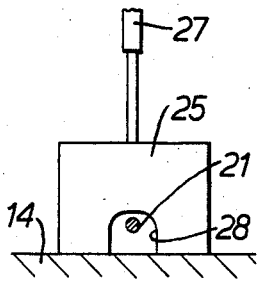
FIG. 3 is a view of a locking wedge of the squeeze casting press of FIGS. 1 and 2 showing an aperture for the passage of a piston of a hydraulic ram.

As best seen in FIG. 3, each locking member 25 is provided at its lower edge with an aperture 28 to allow the passage therethrough of the piston rod 21 of the associated side die part 13. Each locking wedge 25 has an inclined surface 29 which is of complementary angle to the angle of the inclined end surface 23 of the associated side die part 13.

The operation of the squeeze casting press to form a piston for an internal combustion engine or a compressor, is as follows.

Figure 2:
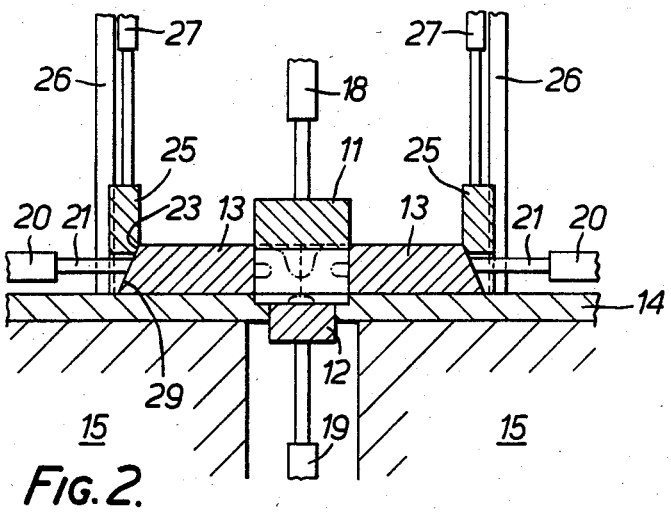
FIG. 2 is a similar view to FIG. 1 but with the parts of the squeeze casting press in a casting-forming position.

The squeeze casting press commences operation in the position shown in FIG. 1. First, the bottom ram 19 is actuated to raise the bottom die part in an initial faster movement followed by a final slower movement to the position shown in FIG. 2 in which the bottom die part fits into the smaller diameter portion 16 of the fixed die part 10 to close the bottom of the die. Next, the side rams 20 are actuated to slide the side die parts towards one another, in this case also with an initial faster movement and final slower movement. This movement continues until the side die parts abut one another (as shown in FIG. 2). In this position, the die cavities 22 are aligned with the larger diameter portion 17 of the fixed die 10 to form the sides of the die. The ends of the side die parts 13 are abutted together to close the sides of the die.

The locking wedge rams 27 are then actuated to lower the locking wedges 25 on the guides 26 to bring the wedge surfaces 29 into engagement with the inclined surfaces 23 on the side die parts 13. The guides 26 act as stops to take the reaction forces from the locking wedges 25 as they force the side die parts 13 together.

The die is then filled with a molten aluminium or aluminium alloy. The top ram 18 is actuated to lower the top die part 11; at a higher speed initially and finally at a slower speed. The top die part 11 enters the aperture formed by the side die cavities 22 to close the die. The top die part may be fitted with an overflow device such as is described in British Patent Specification No. 2,104,810 to ensure that the correct quantity of molten metal is in the die.

The movement of the top die part is then continued to apply to the solidifying metal in the die, a force of tens of tons or even hundreds of tons. The reaction forces on the side die parts 13 (which will, of course, be considerable) are taken by the locking wedges 25 and the guides 26 to prevent the side die parts 13 being forced apart. The pressure is maintained until the metal has solidified to produce a cast piston having a homogeneous structure free from voids and thus of high strength.

After solidification is complete, the movable die parts are retracted in the following sequence. First, the top and bottom rams 18, 19 are actuated simultaneously to retract the upper die part 11 and the lower die part 12. Their movement is initially slower and finally faster. The cast piston 30 (FIG. 1) is left resting on the fixed die part 10.

Next, the locking wedge rams 27 are actuated to retract the locking wedges 25 by sliding them up the guides 26. This releases the side die parts 13 which are then withdrawn by actuation of the side rams 20. The movement of the side die parts 13 is initially slower and finally faster.

This leaves the squeeze cast piston 30 resting on the fixed die part but out of contact with all the movable die parts. The squeeze cast piston is thus readily accessible for removal either manually or robotically.

The squeeze casting press is then ready for a subsequent casting step. Because the fixed die part 10 is so readily accessible, any insert or reinforcement which is to be cast into the piston can be readily placed on the fixed die part before the movable die parts are moved to their casting-forming positions. For example, a cast iron piston ring groove reinforcement or a reinforcement of fibres or a cast combustion bowl or an expansion insert can be located relatively to the fixed die part before casting commences. In addition the casting-forming surfaces of the die parts can be readily cleared and a parting medium can be readily applied to these surfaces.

The top die part 11, the bottom die part 12 and the side die parts 13 have all been shown with plain casting-forming surfaces. It will be appreciated that any or all of these surfaces may be formed with projections or depressions for forming any cast-to-shape features on the casting. For example, the piston can be cast crown-down when the top die part 11 can be formed with a projection which defines the interior shape of the piston. The bottom die part 12 can be formed with a projection which defines a combustion bowl in the casting and the side die parts 13 can be formed with projections for defining partial gudgeon pin bores in the casting. The bore forming-projections are arranged so that the axis of the bore is co-axial with the axes of the pistons 21. This is shown in broken line in FIG. 2.

These projections can be formed integrally with the respective die parts or can be formed by members removably attached to the associated die parts. In this latter case, a range of shapes of the various members can be provided to all the formation of castings having differing features.

It will be appreciated that, in this case, the fixed die part 10 provides a fixed reference for location of the bottom and side die parts 12, 13 no matter what the shape of the projections which they carry. Because of the ability of the press to retract fully all the die parts in directions normal to the associated casting surface, there is no problem in disengaging the projections from the casting and no problem in changing the projecting members mounted on the die parts.

I claim:

1. A squeeze casting press comprising a casting die including a top die part and at least one side die part movable into and out of engagement with other die parts to form the die, the press also including at least one wedge-shaped locking block which engages between a stop and an associated die part, when the die is formed, to prevent movement of the side die part when the top die part applies squeeze casting pressure, the wedge-shaped locking block having an inclined surface engaging with a co-operating inclined surface on the associated die part and being movable out of engagement with the associated side die part after squeeze casting has been performed to allow the side die part to be retracted from the die-forming position to permit the squeeze cast article to be removed.

2. A casting press according to claim 1, wherein the at least one side die part movement is a horizontal rectilinear movement with the associated wedge-shaped locking block being movable in a direction transverse to the direction of said rectilinear movement.

3. A casting press according to claim 2, wherein the direction of movement of the at least one wedge-shaped locking block is a vertical movement.

4. A squeeze casting press comprising:

a casting die, a top die part included in the casting die, at least one side die part included in the casting die, the top die part and the at least one side die part being movable into and out of engagement with other die parts to form the casting die, fixed guides, at least one block slidable in said fixed guides into engagement between an associated side die part and a stop formed by the fixed guides, when the die is formed, to prevent movement of the side die part when the top die applies squeeze casting pressure, the at least one block being slidable in said fixed guides out of engagement with said associated side die part after squeeze casting has been performed to allow the side die part to be retracted from the die-forming position to permit the squeeze cast article to be removed.

5. A casting press according to claim 4, wherein the at least one block and the associated guides are provided with an aperture for the passage therethrough of a hydraulic ram for moving the associated side die part.

6. A casting press according to claim 4, wherein two side die parts are provided, each being movable into and out of respective die-forming positions and each having associated therewith a block.

7. A squeeze casting press comprising:

a casting die for casting a piston for an internal combustion engine, a top die part of the casting die defining an interior shape of said piston, two side die parts of the casting die having respective projections for forming respective gudgeon pin bore parts of said piston, said two side die parts being retractable out of engagement with one another in opposite directions perpendicular to the axis of the gudgeon pin bore to disengage the projections from the casting, two locking blocks one for each side die part, each locking block being movable into engagement with the associated side die part, when the die is formed, to prevent movement of the side die part when the top die applies squeeze casting pressure, each locking block being movable out of engagement with the associated side die part after squeeze casting has been performed to allow said retraction of the side die parts.

8. A casting press according to claim 7 for casting a piston crown-down and including a bottom die part movable into and out of engagement with the other die parts to form the die and having a projection for forming, on the casting, a crown feature such as a combustion bowl.

9. A casting press according to claim 8 and further including a fixed die part which provides reference surfaces for location of the side die parts and the bottom die part in the die-forming position.

10. A casting press according to claim 7, wherein the projections are formed on members removably connected to the associated die parts.

* * * * *